US010414625B2

(12) United States Patent
Gupta

(10) Patent No.: US 10,414,625 B2
(45) Date of Patent: Sep. 17, 2019

(54) DISPENSER FOR ELASTOMERIC MONOFILAMENT CORD USED IN BEADING

(71) Applicant: DPG USA Inc., Schaumburg, IL (US)

(72) Inventor: Nikhil Gupta, Schaumburg, IL (US)

(73) Assignee: DPG USA INC, Schaumburg, IL (US)

( * ) Notice: Subject to any disclaimer, the term of this patent is extended or adjusted under 35 U.S.C. 154(b) by 0 days.

(21) Appl. No.: 15/896,231

(22) Filed: Feb. 14, 2018

(65) Prior Publication Data

US 2018/0229963 A1 Aug. 16, 2018

Related U.S. Application Data

(60) Provisional application No. 62/459,023, filed on Feb. 14, 2017.

(51) Int. Cl.

| | |
|---|---|
| ***B65H 75/28*** | (2006.01) |
| ***B65H 49/20*** | (2006.01) |
| ***B65H 57/18*** | (2006.01) |
| ***B65H 75/32*** | (2006.01) |

(52) U.S. Cl.

CPC ..... *B65H 75/285* (2013.01); *B65H 49/205* (2013.01); *B65H 57/18* (2013.01); *B65H 75/32* (2013.01); *B65H 2701/319* (2013.01)

(58) Field of Classification Search

CPC .... B65H 49/025; B65H 75/285; B65H 75/32; B65H 57/18; B65H 2701/319

See application file for complete search history.

(56) References Cited

U.S. PATENT DOCUMENTS

| | | | | |
|---|---|---|---|---|
| 8,574,385 | B2 * | 11/2013 | Malofsky | B65H 49/205 118/405 |
| 9,162,847 | B2 | 10/2015 | Gupta | |
| 2008/0116218 | A1 * | 5/2008 | Iacona | B65D 85/04 221/26 |
| 2012/0066987 | A1 * | 3/2012 | Malofsky | B65H 49/205 52/173.1 |

* cited by examiner

*Primary Examiner* — William E Dondero

(74) *Attorney, Agent, or Firm* — Robert S. Alexander; Ferrells, PLLC; Anna L. Kinney

(57) ABSTRACT

A dispenser for elastomeric monofilament is provided. The dispenser has a hollow lower half hingedly joined to a mating hollow upper half. Each half has a peripheral wall with vertically extending sidewalls defining an interior and an exterior to the dispenser. A pair of hubs is formed in the sidewalls of one of the halves and a reel is rotably disposed between the hubs. The reel has elastomeric monofilament therearound. A passage from the interior to the exterior of the dispenser is formed at a junction between the halves by a channel formed in each half having a sinuous path through the peripheral wall thereof. The channels are configured such that a sinuous passage is formed from the interior of the dispenser to the exterior of the dispenser by the juxtaposition of the channels when the halves are joined to each other.

6 Claims, 3 Drawing Sheets

DISPENSER FOR ELASTOMERIC MONOFILAMENT CORD USED IN BEADING

CLAIM FOR PRIORITY

This Non-Provisional patent application is based on U.S. Provisional Patent Application Ser. No. 62/459,023, filed on Feb. 14, 2017, the priority of which is claimed, and the disclosure of which is incorporated by reference.

BACKGROUND OF THE INVENTION

Beading is an action activity reportedly practiced by humans as long ago as the Stone Age. Throughout these eons, two common problems have perplexed beaders—broken strings and joining the ends of strings so that the beaded article may be placed around the neck, wrist or ankle and retained in place for as long as desired and then easily removed. In movies and literature, a common scene a faire involves the husband assisting his wife in manipulating the clasp to put on her necklace and indeed, anyone who has ever worn a necklace knows that fastening the clasp can be quite difficult for the person wearing the necklace and even on occasion far from trivial for the person providing the assistance.

SUMMARY OF THE INVENTION

Recently, a partial solution for these problems has been found in the substitution of elastomeric monofilament for conventional beading wires and strings. Typically the elastomeric monofilament is referred to as stretch beading cord, elastic cord, stretch cord and for the technologically precise, elastomeric jewelry cord. The most commonly encountered stretch beading cords seem to be sold under the names Stretch Magic®, Powercord®, Beadnova®, Stretchy String™ as well as a host of others. These products come in a variety of diameters ranging from 0.5 mm up to almost 2 mm as well as a variety of colors including clear, white, black, gold and silver. Typically, these products are sold on small reels about 2 to 3 inches in diameter with a transparent partial "C" ring thereabout to hold the elastomeric cord in position on the reel. Typically the partial "C" ring will span approximately 270° of arc leaving an opening of approximately 90° for removal of the elastomeric monofilament. While this arrangement is workable, it presents problems in use in that it can be difficult to find the end of the monofilament and the ring must be continuously turned if a considerable length of monofilament is to be removed from the reel. Further, there is a known problem with these elastomeric monofilaments in that it can be difficult to join the ends by knotting though this problem is somewhat ameliorated if the elastomeric cord is pre-stretched. Is also recommended that the elastomeric cord be pre-stretched before beads are placed on it so that, over time, the beaded article does not become so enlarged that it no longer fits properly or even ceases to be properly retained upon the wrist if the article is a bracelet. This invention relates to a dispenser particularly suited for dispensing of elastomeric monofilament in the sizes commonly encountered for beading.

The present inventor has previously developed a dispenser for conventional beading wire entitled Wire Dispenser for Beading, U.S. Pat. No. 9,162,847, issued Oct. 20, 2015. The configuration disclosed for this prior art dispenser in U.S. Pat. No. 9,162,847 is primarily concerned with preventing spontaneous unreeling of conventional beading wire due to its considerable stiffness which imparts a considerable tendency to uncoil. In the case of elastomeric monofilament, the problem is more that the heavier, thicker, larger diameter grades of elastomeric monofilament, 1.2 mm and 1.8 mm, have appreciable stiffness while the finer grades, 0.5 mm and 0.8 mm, are droopier with 1 mm elastomeric monofilament, the most widely used grade, being in between. I have found that by providing a dispenser having a channel with a diameter of from about 0.7 to about 0.8 mm through the wall of the dispenser and having a horseshoe bend therein, I am able to conveniently dispense elastomeric monofilament having a diameter ranging from 0.5 up to about 1.2 mm from the same dispenser design thereby eliminating the necessity of stocking different dispensers for each grade of elastomeric monofilament, alleviating the need for the user to go hunting for the end of the monofilament. Particularly, since many beaders are into and past middle-age, finding the end of the elastomeric monofilament can be quite frustrating.

Other aspects and advantages of the present invention are described in the detailed description below and in the claims.

BRIEF DESCRIPTION OF THE DRAWINGS

The invention is described in detail below with reference to the appended drawings, wherein like numerals designate similar parts. In the Figures.

DETAILED DESCRIPTION OF THE PREFERRED EMBODIMENT

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

With respect to the various ranges set forth herein, any upper limit recited may, of course, be combined with any lower limit for selected sub-ranges.

Figure 5:
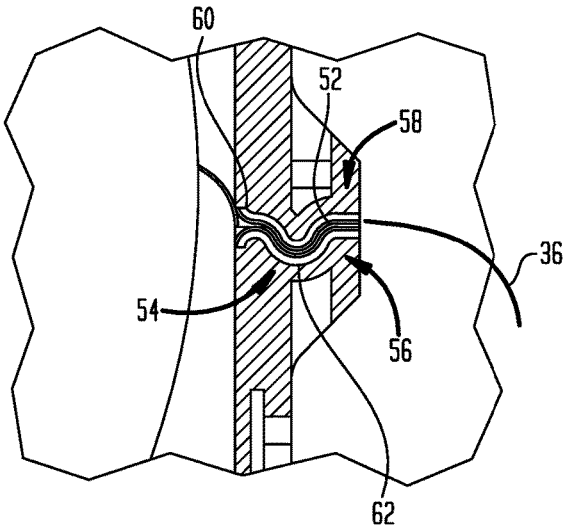
FIG. 5 is a detailed sectional view of the throat of the dispenser of the present invention illustrating the path by which the elastomeric monofilament is removed from the dispenser.
Figure 7:
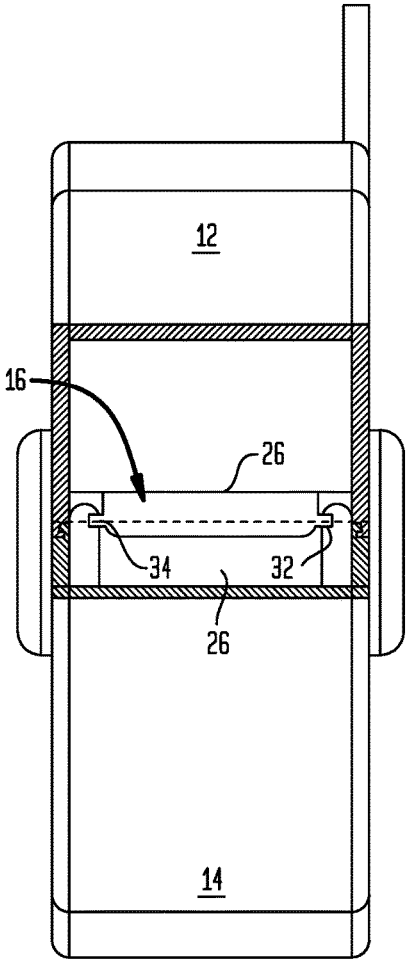
FIG. 7 is a detailed sectional view of the interlocking mechanism of the dispenser of the present invention illustrating the hinge joining the two halves of the dispenser as well as the overlapping lugged walls locking the hinge in the closed position.
Figure 6:
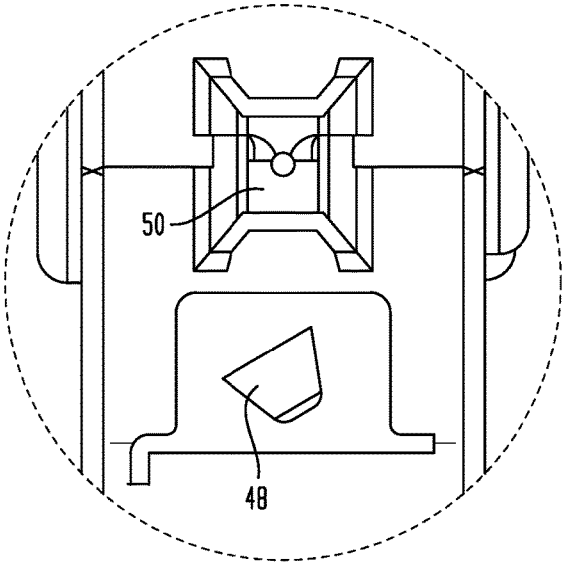
FIG. 6 is an enlarged detail view of the central portion of FIG. 2 illustrating the opening of the throat of the dispenser of the present invention as well as the cutter positioned therebeneath.

Dispenser 10 comprises two mating halves, 12 and 14 joined at hinge 16 having hubs 18, 20 on opposing sidewalls 42 and 44 of lower half 14. Mating halves 12 and 14 are joined along junction line 26 with lugs 28 on upper half 12 nesting within recesses 30 on lower half 14 while halves 12 and 14 are hingedly joined together when pins 32 on upper half 12 are inserted into recesses 34 on lower half 14. The reel 64 carrying elastomeric monofilament 36 revolves around hubs 18 and 20 formed in sidewalls 42 and 44 of lower half 14. Hanging tab 46 is provided to ease display by merchants. Cutter 48 is provided beneath opening 50 of throat 52 on lower half 14 to facilitate severing of a desired length of elastomeric monofilament 36 after withdrawal thereof from dispenser 10. As illustrated in FIG. 5, as elastomeric monofilament 36 is withdrawn through throat 52 it passes through horseshoe bend 54 in throat 52 created by the contours formed in the respective peripheral walls 60 and 62 of upper half 12 and lower half 14 respectively when closed over descending/ascending channel 56 formed in lower half 14 when descending/ascending channel 58 on upper half 12 is superposed thereover.

Figure 2:
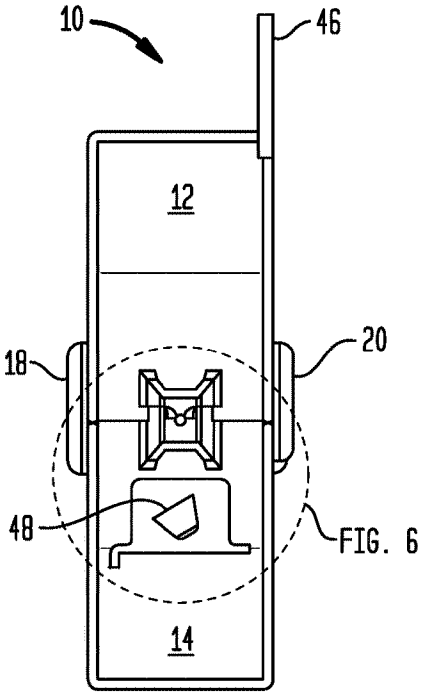
FIG. 2 is a front elevation of the dispenser of the present invention with the dispensing throat and built-in cutter visible.
Figure 1:
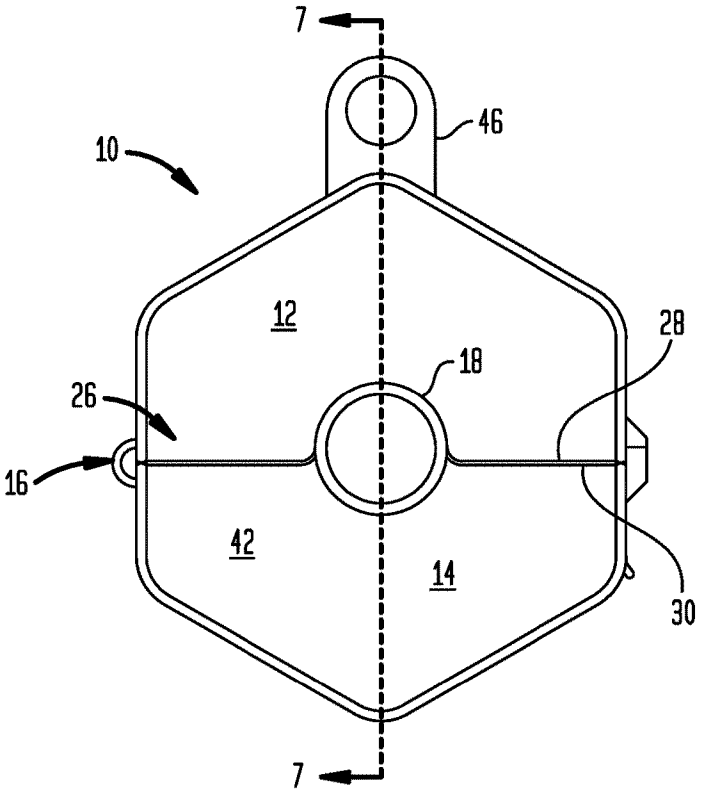
FIG. 1 is a left elevation of the dispenser of the present invention.
Figure 3:
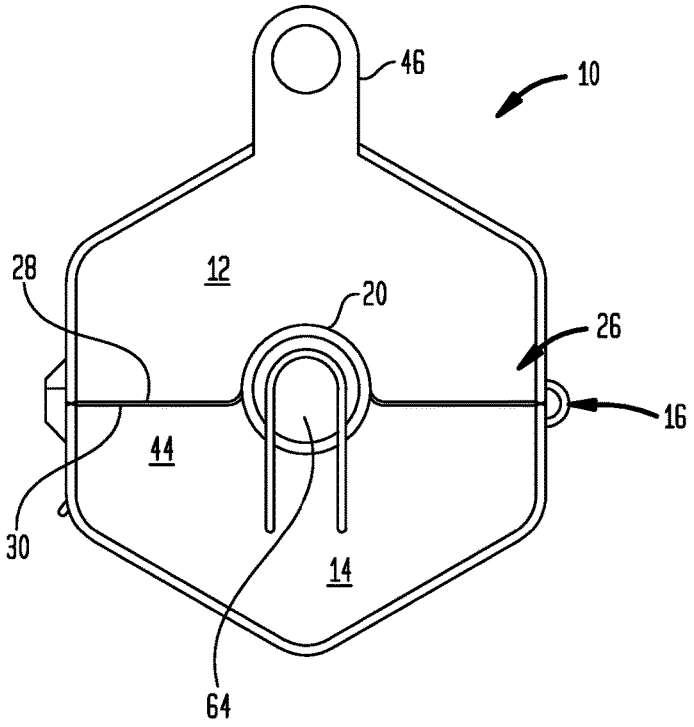
FIG. 3 is a right elevation of the dispenser the present invention.
Figure 4:
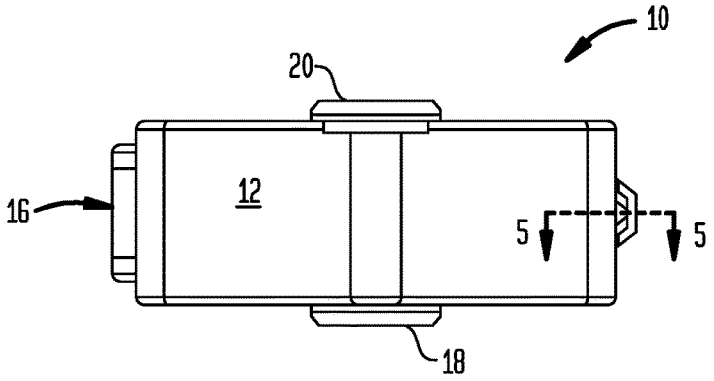
FIG. 4 is a plan view dispenser the present invention.

Conveniently, dispenser 10 is formed by injection molding of high impact transparent thermopolymer to facilitate viewing of elastomeric monofilament 36 deployed therein. As shown in FIGS. 1 and 3, dispenser 10 is formed in the shape of a hexagonal prism to lend a distinctive appearance to Dispenser 10 when displayed in retail establishments. However, if desired, said dispenser may also present a cylindrical profile or any other convenient shape.

While the invention has been described in detail, modifications within the spirit and scope of the invention will be readily apparent to those of skill in the art. In view of the foregoing discussion, relevant knowledge in the art and references discussed above in connection with the Background and Detailed Description, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only, and is not intended to limit the invention.

As my invention, I claim:

1. A dispenser for elastomeric monofilament comprising a hollow lower half hingedly joined to a mating hollow upper half, each half having a peripheral wall comprising vertically extending sidewalls defining an interior and an exterior to said dispenser, a pair of hubs being formed in sidewalls of one of said halves, a reel having elastomeric monofilament therearound being rotably disposed between said hubs, a passage from the interior of said dispenser to the exterior being formed at a junction between said halves by a channel formed in each half having a sinuous path through the peripheral wall thereof, said channels being configured such that a sinuous passage is formed from the interior of said dispenser to the exterior of said dispenser by the juxtaposition of said channels when said halves are joined to each other.

2. The dispenser of claim 1 wherein said channels each have an ascending section and a descending section juxtaposable by joining of said halves to each other.

3. The dispenser of claim 2, wherein said passageway from the interior to the exterior of said dispenser has a diameter of between about 0.8 and 1.0 mm.

4. The dispenser of claim 1, wherein said channels each have laterally veering paths joined by a horseshoe bend when passing through said peripheral wall, said laterally veering paths being juxtaposable to create a laterally veering sinuous passageway from the interior of said dispenser to the exterior when said halves are joined.

5. The dispenser of claim 4, wherein said passageway from the interior to the exterior of said dispenser has a diameter of between about 0.8 and 1.0 mm.

6. The dispenser of claim 1, wherein said passageway from the interior to the exterior of said dispenser has a diameter of between about 0.8 and 1.0 mm.

* * * * *